United States Patent [19]

Rau

[11] Patent Number: 4,773,536

[45] Date of Patent: Sep. 27, 1988

[54] DRILL CASE

[75] Inventor: Georg Rau, Vorstadtrasse, Fed. Rep. of Germany

[73] Assignee: Firma Georg Knoblauch, Giengen/Brenz, Fed. Rep. of Germany

[21] Appl. No.: 67,968

[22] Filed: Jun. 29, 1987

[30] Foreign Application Priority Data

Jul. 2, 1986 [DE] Fed. Rep. of Germany ... 8617667[U]

[51] Int. Cl.[4] ..... B65D 25/28

[52] U.S. Cl. ..... 206/379; 150/109; 190/117; 220/94 A; 16/110.5

[58] Field of Search ..... 206/379; 150/109; 190/117; 220/94 A; 16/110.5

[56] References Cited

U.S. PATENT DOCUMENTS 2,403,825 7/1946 Nissenbaum ..... 206/379

3,891,070 6/1975 Montanari ..... 190/117

4,336,883 6/1982 Krug et al. ..... 190/117 X

*Primary Examiner*—William Price

*Attorney, Agent, or Firm*—Herbert Dubno

[57] ABSTRACT

The case for storing objects, particularly a plurality of tools such as spiral drills, tap drills and the like, comprises a base piece, a cover piece connected pivotally with it and a receptacle portion for the objects. The base piece and the cover piece are each provided with an opening forming a handle portion adjacent an egde of the case opposite a common pivot joint connecting the base piece and the cover piece. The handle portion includes a handle frame member on the base piece which is provided with a substantially U-shape transverse cross sectioned receiving groove open toward the cover piece and a handle strip in the cover piece covering the receiving groove when the case is closed.

4 Claims, 2 Drawing Sheets

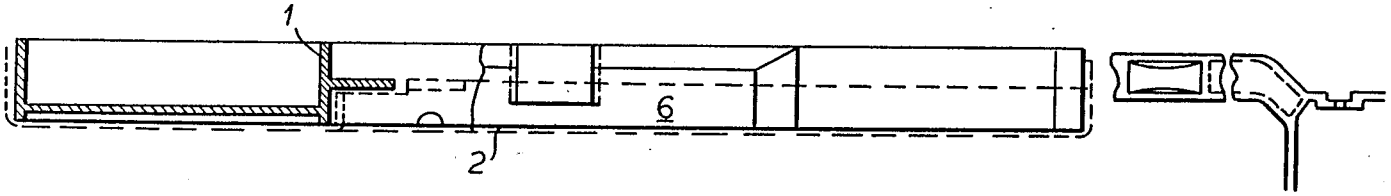
FIG. 4
FIG. 6
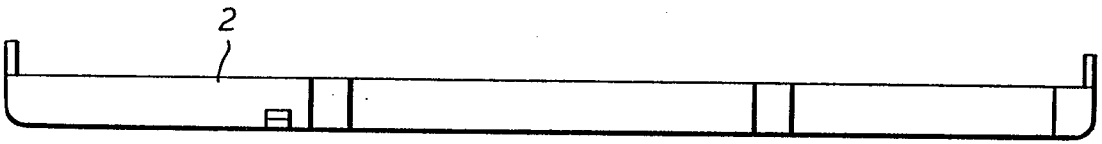
FIG. 5
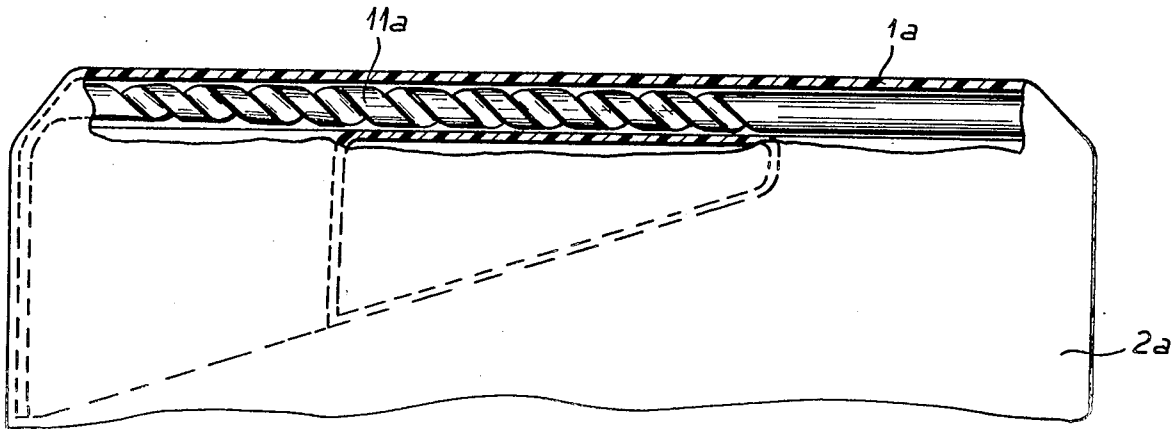
FIG. 7

DRILL CASE

FIELD OF THE INVENTION

My present invention relates to a case for storing objects and, more particularly, to a case or box for tools and especially drills, e.g. spiral drills, tap drills and the like, usually provided in a set of different graduated sizes.

BACKGROUND OF THE INVENTION

A drill case can comprise a base member, a cover member connected pivotally to it and a receptacle portion for the drills. as described for example in German Utility Model 83 18 157.

This case however handles comparatively poorly in transport when it is of a comparatively large size for carrying a large number of drills.

There is also a danger that the case can be dropped by those whose carry it on account of its high weight and can be damaged by impact on the ground or even destroyed, especially if the case is made of plastic.

OBJECTS OF THE INVENTION

It is an object of my invention to provide an improved case for storing objects, particularly tools such as a spiral drills, tap drills and the like which will obviate drawbacks of the drill case described.

It is also an object of my invention to provide an improved case for storing and transporting drill bits or like elongated tools in which a handle portion of this case is reinforced so that handle breaking is reduced or avoided.

It is another an object of my invention to provide an improved case for storing and transporting drill bits which distributes the load experienced in carrying the case more uniformly longitudinally so that handle stresses are reduced.

SUMMARY OF THE INVENTION

These objects and others which will become more readily apparent hereinafter are attained in accordance with my invention in a case for storing and transporting objects, particularly a plurality of tools such as spiral drill bits, tap drill bits and the like, comprising a base member, a cover member connected pivotally with it and a receptacle portion for the objects.

According to my invention the base member and the cover member are each provided with an opening forming a handle portion adjacent an edge of the case opposite a common pivot joint. The handle portion includes a handle frame member on the base member which is provided with a substantially U-shape transverse cross section receiving groove open toward the cover member and a handle strip in the cover member covering the receiving groove when the case is closed.

Advantageously the handle member can be connected by a plurality of inclined connecting members protruding beyond the adjacent edge of the case to the cover member and/or the base member so that shear forces occurring at the end of the handle cannot lead under high loads to damage or to possible tearing away of the handle.

This leads to a more uniform distribution of forces at the ends of the handle members.

Advantageously the handle strip in the cover member can have a U-shape in transverse cross section, the legs of the U-shape cross section embracing or surrounding the handle frame member when the case is closed. Because of that higher loads can be borne and the closure of the handle frame member results in a dust tight seal.

Advantageously then a more uniform distribution of forces over the entire long side of case occurs. However it is also possible to provide the receptacle groove exclusively in the vicinity of the handle portion and to have a shorter object in it like for example a center punch.

BRIEF DESCRIPTION OF THE DRAWING

The above and other objects, features and advantages of my invention will become more readily apparent from the following description, reference being made to the accompanying highly diagrammatic drawing in which:

FIG. 4 is a partial cross sectional view taken along the section line IV of FIG. 1, and partially in plan view;

FIG. 5 is a plan view of the cover member of the case corresponding to that of FIG. 4;

FIG. 6 is a cutaway partial view in the direction VI shown in FIG. 3; and FIG. 7 is a fragmenting in plan view of another embodiment.

SPECIFIC DESCRIPTION

Figures 1, 2, 3:
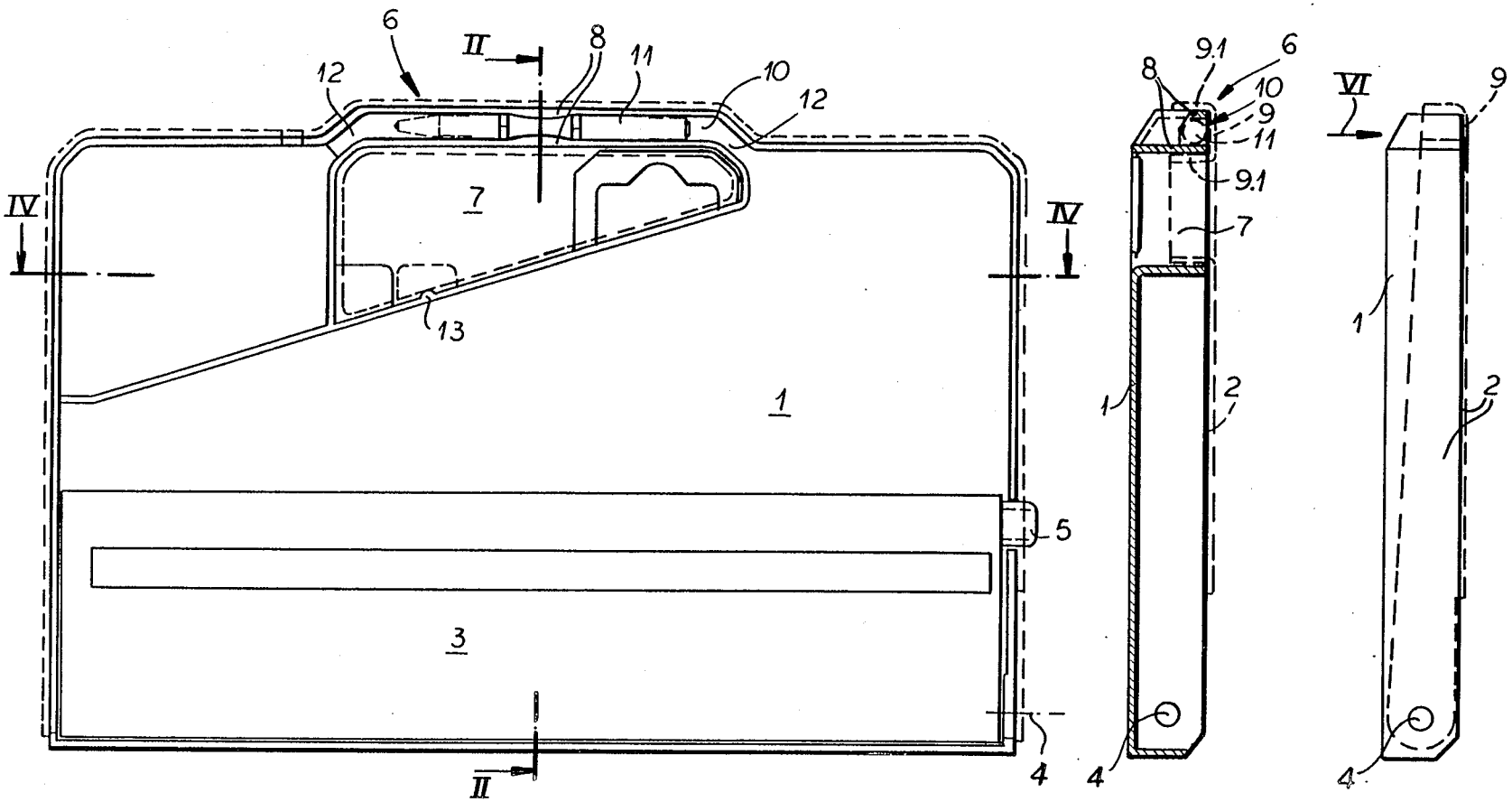
FIG. 1 is a top plan view of a case for objects according to my invention.
FIG. 2 is a cross sectional view through the case taken along the section line II—II of FIG. 1.
FIG. 3 is side elevational view of the case.

The case shown in the drawing can be used to store a plurality of objects which have not been shown, particularly elongated tools like a set of spiral drills, tap drills or the like.

In particular the case comprises a base member 1, a cover member 2 connected pivotally to it and a receptacle portion 3 for the objects which is mounted pivotally on the base member 1 with a common pivot axis 4 and is pivotable away from it so it can receive or dispense the objects by a gripping lug 5. The receptacle portion 3 is not shown in detail. It is however provided with seats, e.g. holes which dimensioned respectively to fit the objects received and stored by the case. The receptacle holes can be of stepped diameter matching the diameters of the drill bits of the set.

The base member 1 and the cover member 2 are provided with openings 7 forming a handle portion 6 adjacent the edge opposite from the common pivot 4. The handle portion 6 is formed jointly by a handle frame member 8 associated with the base member 1 and a handle strip 9 located in the cover member 2.

Thus the handle frame member 8 is provided with a longitudinally oriented receiving groove 10 with a substantially U-shape transverse cross section open toward the cover member 2 for a substantially cylindrical object 11 while the handle strip 9 of the cover member 2 covers the receiving groove 10 when the case is closed.

The object 11 in the receiving groove 10 which is a center punch in this example bestows an increased strength on the handle portion 6 so that bending of the handle portion 6 with the accompanying danger of breaking is avoided.

As is apparent from FIG. 1 the handle portion 6 is connected to cover and base members 1, 2 by the inclined connecting members 12 protruding beyond the edge of the case. Thus shearing forces occurring at the end of the handle portions 6 which can give rise to breaks in this region are reduced.

In cases which experience a particularly high load it is also possible to eliminate the inclined connecting members 12 and instead of them to extend the receiving groove 10 on both sides of the handle portion 6 so that a longer object, such as a sheathing drill bit, can be received by it. This is shown in FIG. 7 where the sheathing drill 11*a* is received in the extended groove and is held between the cover 2*a* and base 1*a*. Thus a more uniform distribution of forces along the entire edge of the case can be attained.

As is apparent particularly from FIG. 2 the handle strip 9 in the cover member 2 has a U-shape transverse cross section. The legs 9.1 of the U of the handle strip 9 embrace or surround the handle frame member 8 with the case closed.

This gives rise to both an increased stability for the handle portion and a dust tight closure of the receiving groove 10 are attained.

Although the case in the closed state in transport is held by grasping the handle portion 6 with the hand, the base member 1 has additionally a clasp nose 13 provided on the edge of the openings 7 by which the cover member 2 is clamped and secured on closing the case.

I claim:

1. In a drill-bit case comprising a base member, a cover member connected pivotally with said base member and a recaptacle portion for said objects, the improvement wherein said base member and said cover member are each provided with an opening forming a handle portion located along an edge of said case opposite a common pivot joint between said members, said handle portion including a handle frame member on said base member which is provided with a substantially U-shape transverse cross section receiving groove opening toward said cover member and a handle strip covering said receiving groove when said case is closed, said handle strip being formed on said cover member and having a U-shape in transverse cross section, the legs of said U-shape transverse cross section of said handle strip embracing said handle frame member when said case is closed, said groove receiving an elongated tool for distributing force therealong.

2. The improvement defined in claim 1 wherein said handle portion is connected by a plurality of inclined connecting elements to members.

3. A drill-bit case comprising:

a base member;

a cover member connected pivotally with said base member at a common pivot joint along an edge of the case;

a receptacle portion for drill bits pivotally connected at said joint to both said members and received between them;

a handle portion along an edge of said case opposite said common pivot joint formed by openings provided in both of said base member and said cover member, said handle portion including a handle frame member on said base member which is provided with a substantially U-shape transverse cross section receiving groove opening toward said cover member, and a handle strip formed on said cover member covering said receiving groove when said case is closed;

a plurality of inclined connecting members connecting said handle portion to said members; and an elongted tool in said groove for distributing force therealong.

4. In a drill-bit case comprising a base member, a cover member connected pivotally with said base member and a receptacle portion for said objects, the improvement wherein said base member and said cover member are each provided with an opening forming a handle portion located along an edge of said case opposite a common pivot joint between said members, said handle portion including a handle frame member on said base member which is provided with a substantially U-shape transverse cross section receiving groove opening toward said cover member and a handle strip covering said receiving groove when said case is closed, an elongated tool being received in said groove for distributing force therealong.

* * * * *